US009310063B1

(12) United States Patent
Lauer

(10) Patent No.: US 9,310,063 B1
(45) Date of Patent: Apr. 12, 2016

(54) LIGHTING DEVICE WITH FINS THAT CONDUCT HEAT AND REFLECT LIGHT OUTWARD FROM LIGHT SOURCES

(71) Applicant: Mark A. Lauer, Pleasanton, CA (US)

(72) Inventor: Mark A. Lauer, Pleasanton, CA (US)

( * ) Notice: Subject to any disclaimer, the term of this patent is extended or adjusted under 35 U.S.C. 154(b) by 128 days.

(21) Appl. No.: 14/197,630

(22) Filed: Mar. 5, 2014

Related U.S. Application Data

(60) Provisional application No. 61/778,180, filed on Mar. 12, 2013.

(51) Int. Cl.
*F21V 9/16* (2006.01)
*F21V 29/00* (2015.01)
*F21K 99/00* (2010.01)

(52) U.S. Cl.
CPC ..... *F21V 29/004* (2013.01); *F21K 9/10* (2013.01)

(58) Field of Classification Search
CPC ..... G02B 6/0025; F21V 29/004; F21K 9/10
USPC ..... 362/84
See application file for complete search history.

(56) References Cited

U.S. PATENT DOCUMENTS

| | | | | |
|---|---|---|---|---|
| 7,726,836 | B2 * | 6/2010 | Chen | 362/249.02 |
| 8,092,045 | B2 * | 1/2012 | Xiao et al. | 362/249.02 |
| 8,536,807 | B2 * | 9/2013 | Lin et al. | 315/358 |
| 2006/0193130 | A1 * | 8/2006 | Ishibashi | 362/227 |
| 2011/0080096 | A1 * | 4/2011 | Dudik et al. | 315/112 |
| 2011/0255268 | A1 * | 10/2011 | Horn et al. | 362/101 |
| 2012/0026723 | A1 * | 2/2012 | Wheelock et al. | 362/101 |

* cited by examiner

*Primary Examiner* — Elmito Breval
*Assistant Examiner* — Hana Featherly
(74) *Attorney, Agent, or Firm* — Mark Lauer; Silicon Edge Law Group LLP

(57) ABSTRACT

Illumination devices are disclose having at least three thermally conductive fins that are attached to each other adjacent a central location and extend outward from the central location, with each of the fins having an opposed pair of major surfaces. The devices include a plurality of light-emitting diodes that emit light and produce heat, with at least one of the light-emitting diodes being mounted on each of the fins. The heat from the light-emitting diode flows along the fin and is radiated from at least one of the major surfaces, while the light from the light-emitting diode is reflected from the major surfaces of adjacent fins and exits the device.

21 Claims, 10 Drawing Sheets

LIGHTING DEVICE WITH FINS THAT CONDUCT HEAT AND REFLECT LIGHT OUTWARD FROM LIGHT SOURCES

CROSS-REFERENCE TO RELATED APPLICATION

This application claims the benefit under 35 U.S.C. §119 of Provisional Application No. 61/778,180, filed by the present inventor on Mar. 12, 2013, which is incorporated herein by reference.

BACKGROUND

The present application relates to lighting and illumination devices and systems.

It is well known that conventional light sources also emit heat that may be undesirable. For example, it has been known for over a century that incandescent light bulbs may waste energy by generating a substantial amount of heat as well as light. On the other hand, it has been known for many decades that light emitting diodes (LEDs) may waste less energy in producing light, but are less efficient and can have reduced lifetimes when operated at elevated temperatures produced by the LEDs. Moreover, LED lighting devices have a much higher upfront cost than incandescent light bulbs, although the cost may be recouped over time if the LED lifetime is sufficient. Thus, there is a longstanding need for a lighting device that is more efficient and long-lived, yet cost-efficient.

SUMMARY

In one embodiment, an illumination device is disclosed comprising: a plurality of light sources that produce heat and emit light; and a plurality of thermally conductive fins that extend outward from a central location such that a distance between each adjacent pair of the fins generally increases with increasing distance from the central location, each of the fins having an opposed pair of major surfaces, each of the fins being in thermal contact with a respective one of the light sources to flow the heat from the light source away from the central location, such that the heat radiates from the major surfaces, while the light is reflected from at least one of the major surfaces to be directed away from the central location.

In one embodiment, an illumination device is disclosed comprising: a plurality of thermally conductive fins that are attached to each other and extend outward from a central location, each of the fins having an opposed pair of major surfaces; and a plurality of light sources that emit light and produce heat, each of the light sources being mounted on a respective one of the fins to flow the heat from the light source along the fin and to radiate the heat from the major surfaces, while the light from the light source is reflected from at least one of the major surfaces and exits the device.

In one embodiment, an illumination device is disclosed comprising: a plurality of thermally conductive fins that are attached to each other adjacent to a central location, each of the fins having an opposed pair of major surfaces and extending radially outward from near the central location to an outer edge; and a plurality of light sources that emit light and produce heat, each of the light sources being in thermal communication with at least one of the fins and being disposed closer to the central location than to the outer edge of the one fin, wherein heat from the light sources radiates from the major surfaces of the fins, and light from the light sources is reflected outward from at least two of the major surfaces to exit the device.

This summary does not purport to define the invention, embodiments of which are described throughout this application, and which is defined by the appended claims.

DETAILED DESCRIPTION

Figure 1:
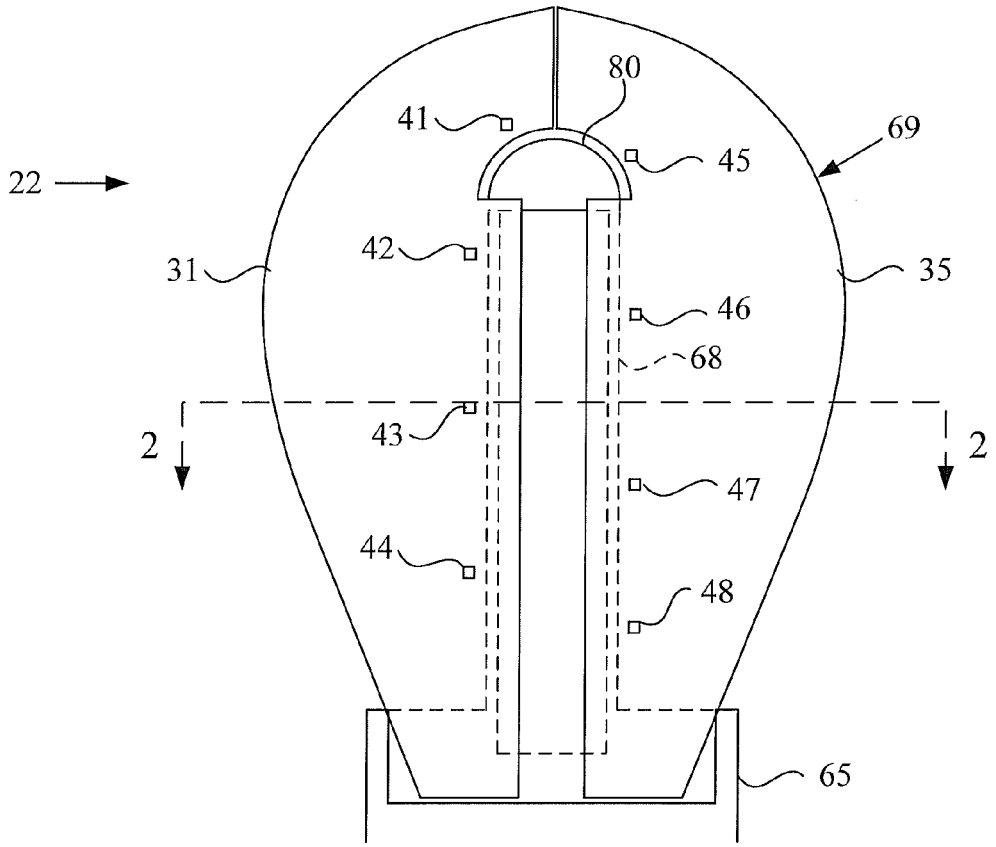
FIG. 1 is a side cross-sectional view of an embodiment of an illumination device including a plurality of thermally conductive fins that reflect light and flow heat from a plurality of light sources.
Figure 2:
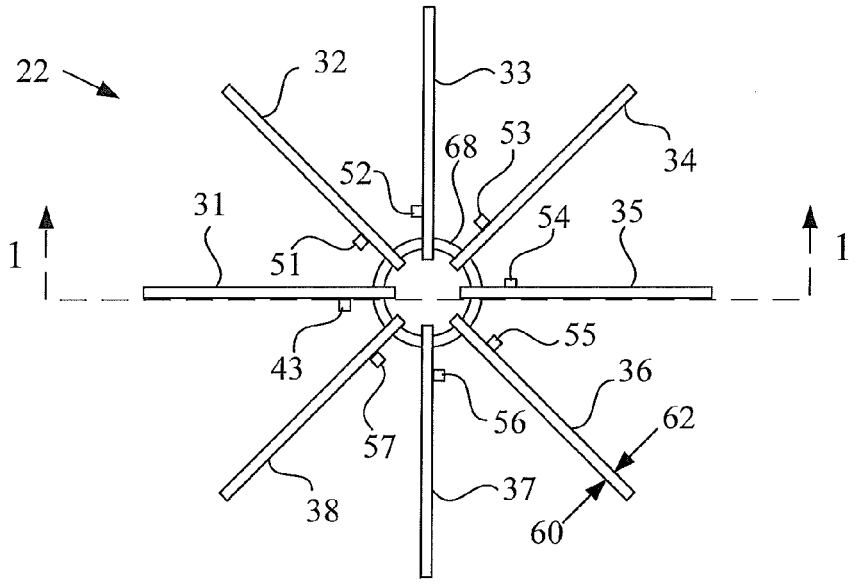
FIG. 2 is a top cross-sectional view of the illumination device of FIG. 1.

FIG. 1 shows a side cross-sectional view of an embodiment of an illumination device 22. FIG. 2 shows a top cross-sectional view of the illumination device 22. The illumination device 22 has a plurality of thermally-conductive and light-reflective fins 31-38. Mounted on each of the fins is at least one light source, such as light emitting diodes LEDs 41-48 and 51-57. Each of the fins has a plurality of major surfaces, such as surfaces 60 and 62 of fin 36.

The fins 31-38 fit into slots in a base 65 and stand 68 to be essentially radially aligned with an axis of the cylindrical stand 68, so that the fins are attached to each other near a central location and extend outward to terminate in an outer edge such as edge 69. LEDS 45-48 can be seen in this embodiment to be generally closer to the central location than to the outer edge 69. The fins 31-38 are made of material having a high thermal conductivity at about room temperature, such as aluminum, copper or other such metals, or some ceramics or dielectrics, such as alumina or diamond, to allow heat to flow from the LEDs and radiate from the major surfaces of the fins. In general, the fins should have a thermal conductivity of at least about 10 W/m K at 300° K. The major surfaces, such as surfaces 60 and 62 of fin 36, reflect visible light from the LEDs, so that the light travels outward from illumination device 22.

Figure 3:
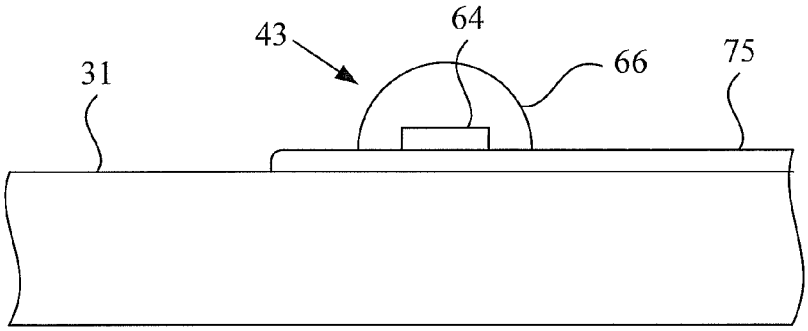
FIG. 3 is an expanded cut-away cross-sectional view of a fin and light source of FIG. 1.

FIG. 3 shows an expanded cross-sectional view of fin 31 and LED 43, viewed from the opposite direction of that of FIG. 2. LED 43 includes a surface emitting multilayer chip 64 and translucent protective cover 66 in this embodiment, although other known forms of LEDs may alternatively be employed. LED 43 is mounted on fin 31 via an electrically insulating, thermally conductive layer 75 in this embodiment in which fin 31 is electrically conductive.

Figure 4:
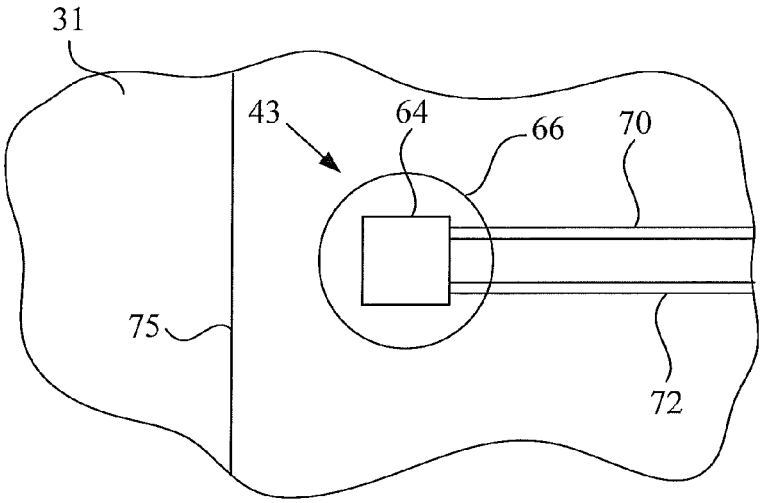
FIG. 4 is a cut-away top view of the fin and light source of FIG. 3.

FIG. 4 is a cut-away top view of the fin 31 and LED 43 of FIG. 3, showing electrical leads 70 and 72, which provide power to the LED. In one embodiment, fins 31-38 can be machined from sheet metal, for example, and electrically insulating, thermally conductive layer 75 and leads 70 and 72 can be created by semiconductor processing techniques, such as masked deposition, so that LEDs 41-48 and 51-57 can be easily and efficiently mounted on fins 31-38. Because conventional LED light bulbs have a high upfront cost compared to conventional incandescent bulbs, the reduced manufacturing cost made possible by the present invention has significant advantages. Similarly, such a cost-effective illumination device has synergistic advantages over conventional devices that employ thermally-conductive fins to dissipate heat, by efficiently utilizing thermally-conductive fins that dissipate heat to also broadcast light.

Figure 5:
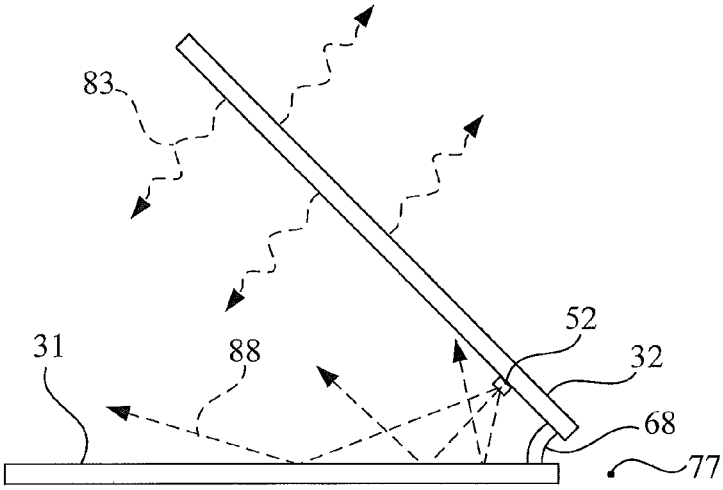
FIG. 5 is an enlarged view of two of the fins of FIG. 2, with an LED emitting light that reflects off at least one of the fins and heat radiating from at least one of the fins.

FIG. 5 is an enlarged view of fins 31 and 32 and LED 52 of FIG. 2, with exemplary light rays 88 from LED 52 reflecting off at least fin 31 and exemplary heat waves 83 radiating from fin 32. Stand 68 may reflect light from the LEDs and may contain lead wires that connect to leads such as leads 70 and 72 for the LEDs. In the embodiment shown in FIG. 1, stand 68 has a semispherical reflective cap 80 that helps to broadcast light from LEDs 41 and 45 upward from the stand. Although the embodiment shown in FIGS. 1 and 2 has eight fins, more or less fins can be used. Narrowing the angle between fins can increase the number of times that particular light rays are reflected, which can broaden the distribution of the light that exits the device. The reflection of light provided by fins 31-38 may be like that of a mirror, providing a jeweled appearance, although optional coatings on the major surfaces should be thermally conductive to radiate heat, albeit not necessarily as thermally conductive as the bulk of the fins.

Alternatively, the reflection may be more in the nature of scattering, either on a microscopic level or with facets that may be perceptible without a microscope. In any event, the major surfaces are reflective in the sense that the vast majority of the light energy that impinges upon the major surfaces of the fins either directly or indirectly from the LEDs is not absorbed by the fins. In general, at least about 85% of such light that strikes a fin normal to the fin's major surface should be redirected or reradiated rather than absorbed, so that the fins help to distribute the LED light outward from the device 22. Due to the angle between adjacent fins, light that bounces between major surfaces of those fins is increasingly directed outward from the central location of the device, which in FIG. 5 is shown as axis 77. Although not shown in this embodiment, portions of the fins may be thicker adjacent to the LEDs compared to portions disposed further from the central location and closer to the terminal edge, increasing the capacity for heat flow near the LEDs. For example, the fins may be tapered to decrease in thickness further from the central location, or may change in thickness as a step that abuts a translucent shroud.

Figure 6:
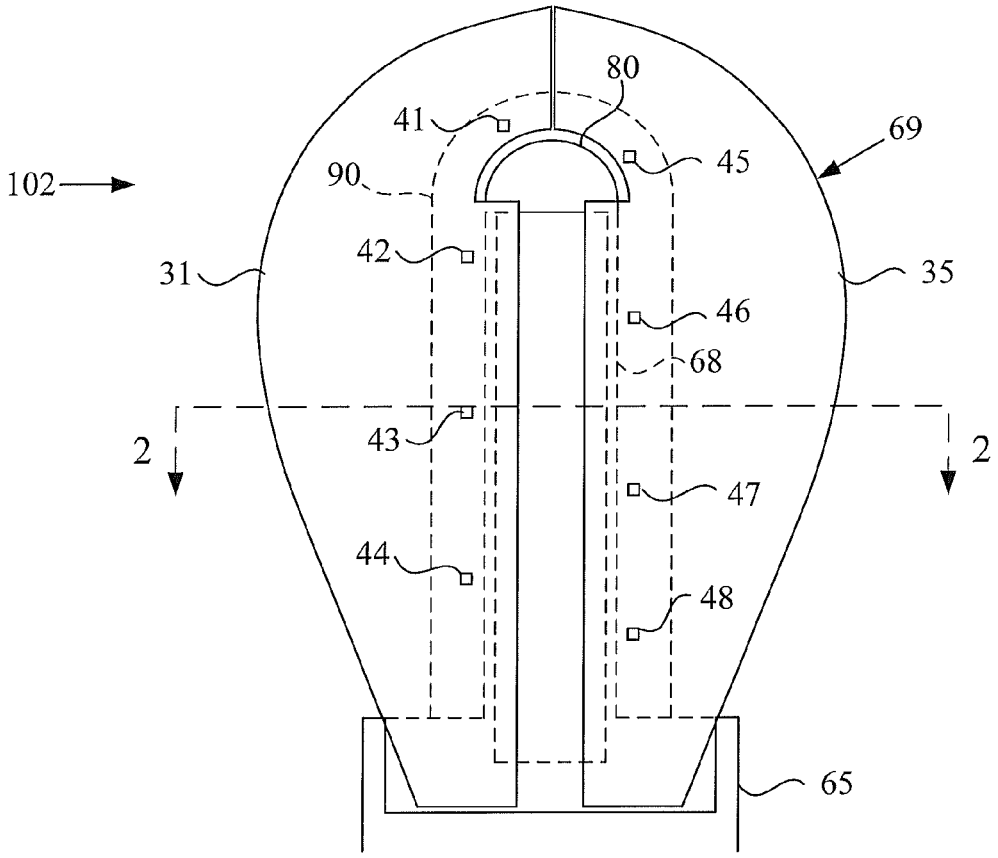
FIG. 6 is a side cross-sectional view of an illumination device which includes a translucent shroud.
Figure 7:
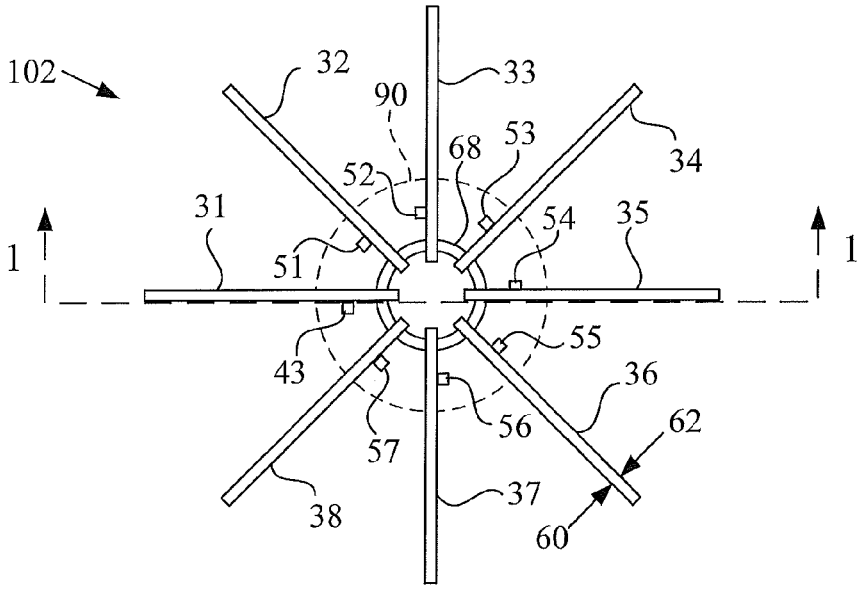
FIG. 7 is a top cross-sectional view of the illumination device of FIG. 6 including the translucent shroud.

FIG. 6 is a side cross-sectional view of illumination device 102 which includes a translucent shroud 90. FIG. 7 shows a top cross-sectional view of the illumination device 102 including translucent shroud 90. Shroud 90 redirects light from LEDs to smooth and distribute that light, and may retransmit light of a different frequency than that emitted by the LEDs, for example by containing fluorescent phosphors. Shroud 90 includes a plurality of sections that can be attached to the fins and can provide support for the fins. In one embodiment, shroud 90 may constrain air flow adjacent to the LEDs, but the portions of the major surfaces of each fin outside the region confined by the shroud afford sufficient radiative cooling to protect the LEDs from overheating, those portions also serving to reflect the LED light redirected by the shroud. Also, the amount of heat radiated within the region confined by shroud 90 can be lowered for example by reducing the surface area of the portion of the fins within the shroud, as well as by increasing the thickness of the thermally conductive material of that portion of the fins. Stated differently, a ratio of surface area to thickness may be much greater (e.g., more than double) for the region of the fins outside the shroud compared to the region enclosed by the shroud. Although shroud 90 is shown as essentially cylindrical except for a semispherical cap, it may instead be different shapes, such as following the contour of the outer edge 69 of the fins.

The base 65 in this embodiment includes a conductive threaded base portion, not shown, that is designed to screw into a conductive threaded socket. The threaded base portion and the socket may both correspond to a standard fitting size such as an "Edison Screw" E10, E11, E12, E14, E17, E25, E26, E27, E29, E39 or E40. Alternatively, such an illumination device can be made with a standard two-pronged "Bayonet Cap" fitting, such as BC or B22. Providing an illumination device with such standard fittings allows the illumination device to serve as an easily implemented replacement for common incandescent light bulbs. Conventional methods for providing a current and voltage appropriate for the LEDs may be employed.

Figure 8:
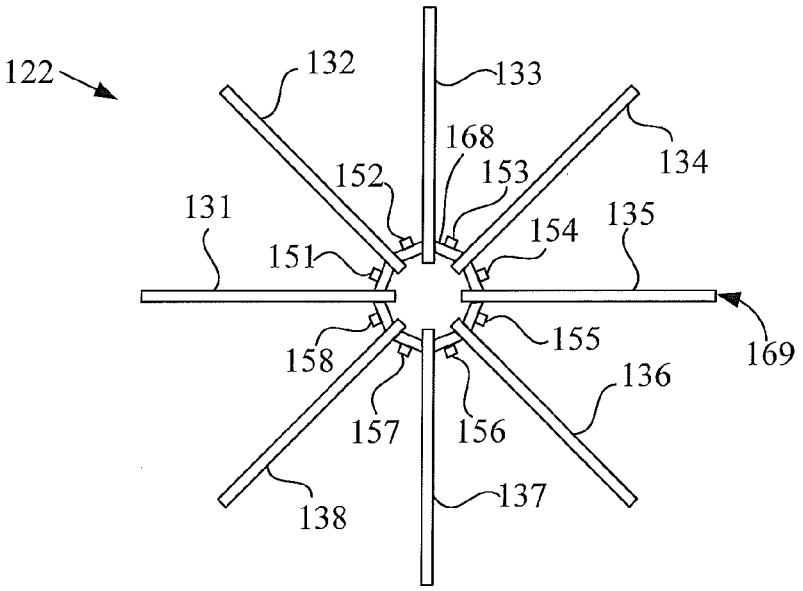
FIG. 8 is a cross-sectional view of an embodiment of an illumination device in which LEDs are mounted on thermally conductive regions disposed between the fins.

FIG. 8 is a cross-sectional view of an embodiment of an illumination device 122 similar to that shown in FIG. 2, but in which LEDs 151-158 are mounted on the portions of the stand 168 disposed between the fins 131-138. In this example as well as others, stand portions 168 may for instance be flat or convex rather than concave, but must be in thermal communication with the fins to provide heat flow from the LEDs. The stand portions 168 may be thicker than the fins 131-138, with a thermally conductive epoxy, grease or other substance filling any gaps between the two to ensure good thermal conductivity between the stand portions and the fins. Alternatively, the stand and fins may be integrated, for instance from being cast together. As with other embodiments, the LEDs may be edge emitting rather than surface emitting. Also, although not shown in this figure, a translucent shroud may encircle the LEDs, the shroud preferably disposed closer to the central location than to the outer edge 169 of the fins.

Figure 9:
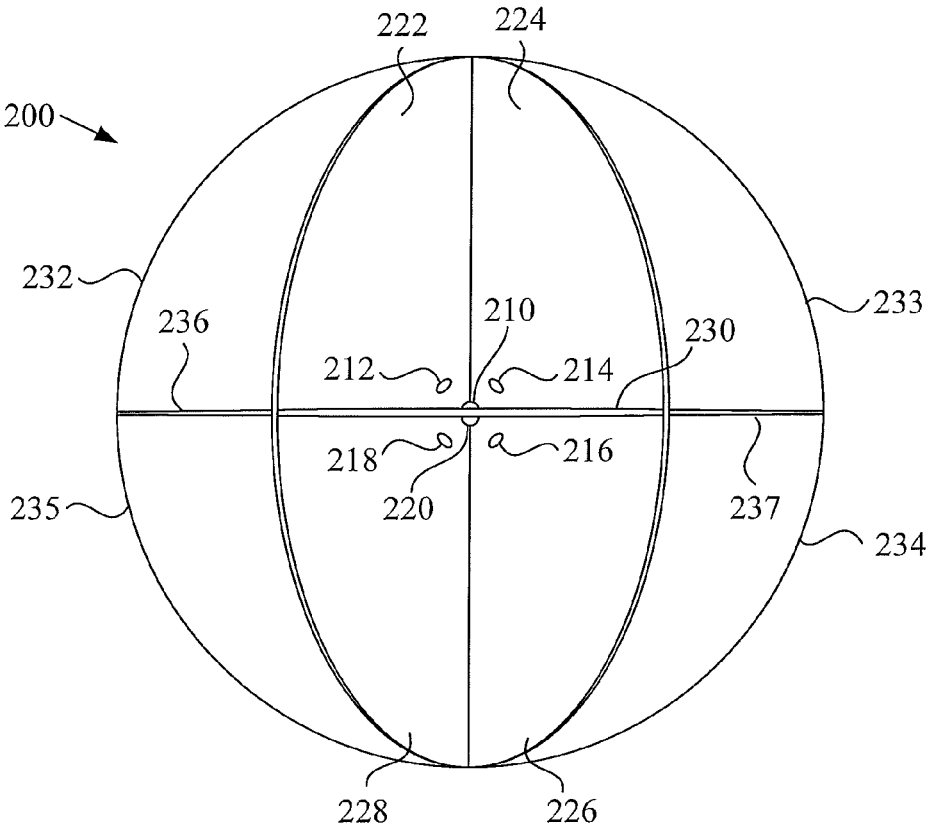
FIG. 9 is a perspective view of an embodiment of a spherical illumination device in which LEDs are mounted on thermally conductive, light reflective fins.

FIG. 9 is a perspective view of an embodiment of an illumination device 200 in which LEDs 210, 212, 214, 216, 218 and 220 are mounted on thermally conductive, light reflective fins 222, 224, 226, 228 and 230. Additional fins 232-237 also may be mounted with LEDS, not shown. Conductive lead traces encased in insulators may be deposited on the fins to provide power to the LEDs, for instance with apertures near the center of the device, such as in fins 230, 236 and 237, allowing leads to pass through. Illumination device 200 may be attached to a base that can screw into a conventional socket, or may be hung from a chain like a chandelier. For the situation in which the major surfaces of the fins reflect light like a mirror, optionally with multiple facets on each major surface, the illumination device may have a jeweled appearance, whether the LEDs are turned on or off. In one embodiment, different LEDs of such an illumination device can flash on and off at different times, enhancing the sparkling appearance.

Figure 10:
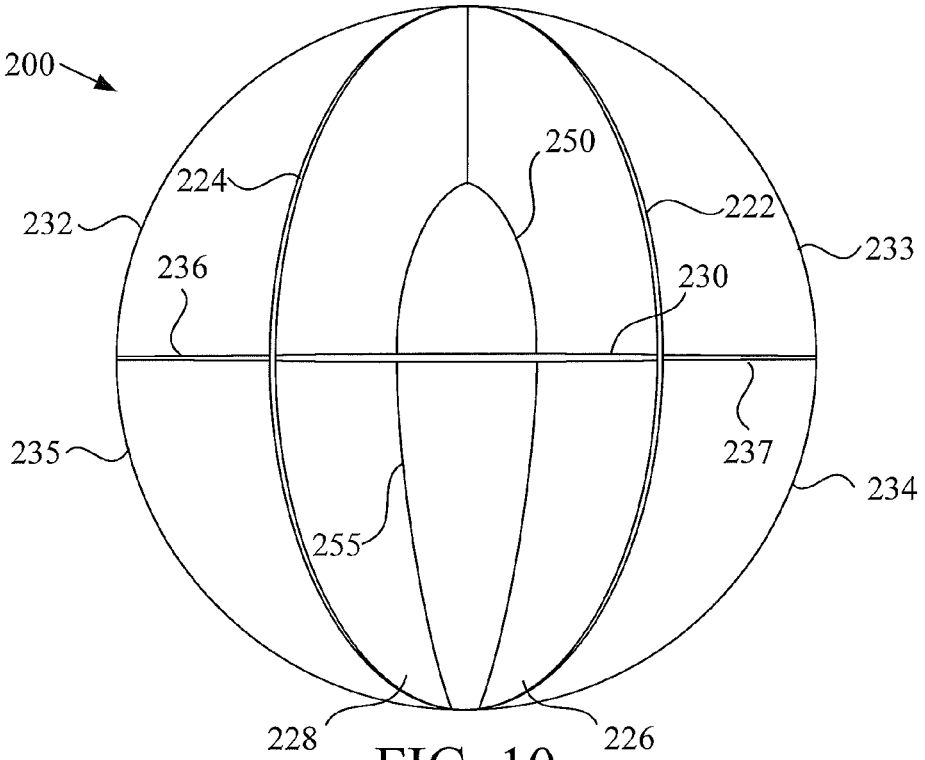
FIG. 10 is a perspective view of an illumination device in which the LEDs shown in FIG. 9 are disposed within a translucent shroud.

FIG. 10 is a perspective view of an embodiment of illumination device 200 in which the LEDs shown in FIG. 9 are disposed within a translucent shroud including shroud portions 250 and 255. Leads for the LEDs can also be obscured from vision by the shroud portions 250 and 255. Shroud portion 250 is attached to fins 222, 224 and 230, and shroud portion 255 is attached to fins 226, 228 and 230. Similar shroud portions, not shown, are attached to fins 232-237. The shroud portions smooth and redirect the light from the LEDs, and may absorb and reradiate some or all of the light. For example, the shroud portions may contain phosphors that fluoresce when radiated by the LEDs.

The shroud portions may also be made with holes that allow air to pass through from the region containing the LEDs to the outside, cooling the region containing the LEDs. For example, the shroud portions may be made of translucent polymer fibers or a translucent mesh that has openings in the weave. As another example, the shroud portions may be perforated or have holes like a honeycomb. In this case, the shroud portions may help to hold the fins in place, so that a central opening can be formed between the fins, allowing air to circulate more freely. For example, an axial opening between the fins in the region covered by the shroud portions can allow air to flow through the holes in the shroud portions from one side of the device 200 to the other, as well as provide a conduit for electrical leads. Similarly, convection can better cool the region covered by the shroud portions for an embodiment having a central opening between the fins. Also, the portion of the fins that is within the shroud can be coated with a layer of thermally insulative material that reflects light, concentrating the radiative cooling in the area of the fins not enclosed by the shroud.

Figure 11:
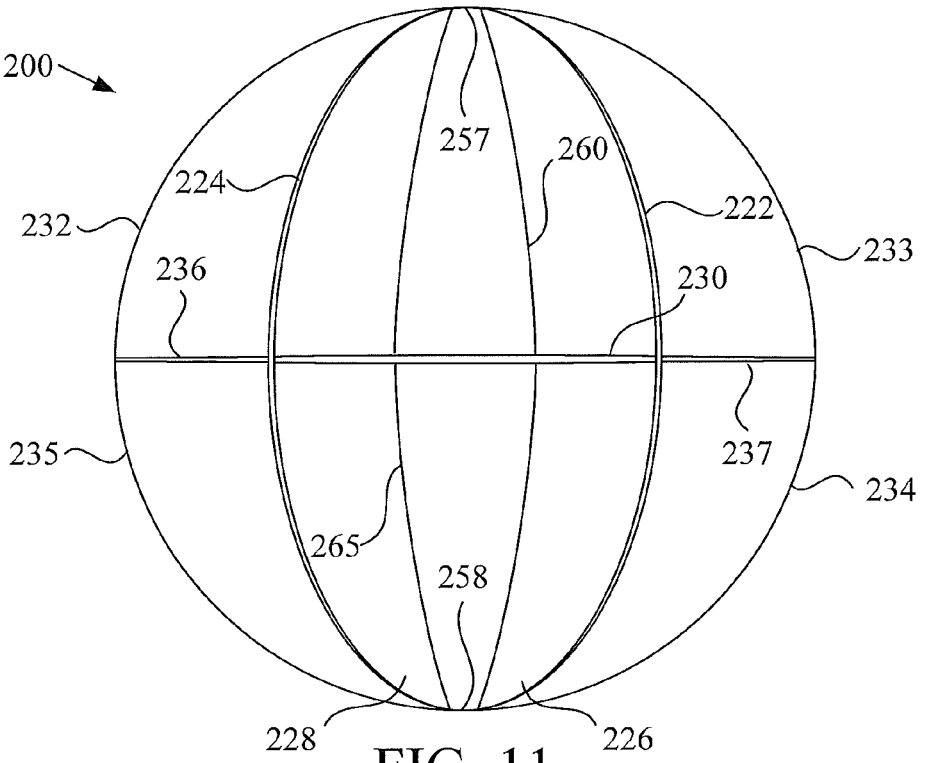
FIG. 11 is an embodiment similar to that of FIG. 10, with an axial opening including apertures that allow air to flow through the device, the axial opening encircled by a shroud.

FIG. 11 shows an embodiment similar to that of FIG. 10, but with an axial opening including apertures 257 and 258, the axial opening encircled by a shroud including shroud portions 260 and 265. The embodiments shown in FIG. 10 and FIG. 11 can be attached to a base such as base 65 shown in FIG. 1.

Figure 12:
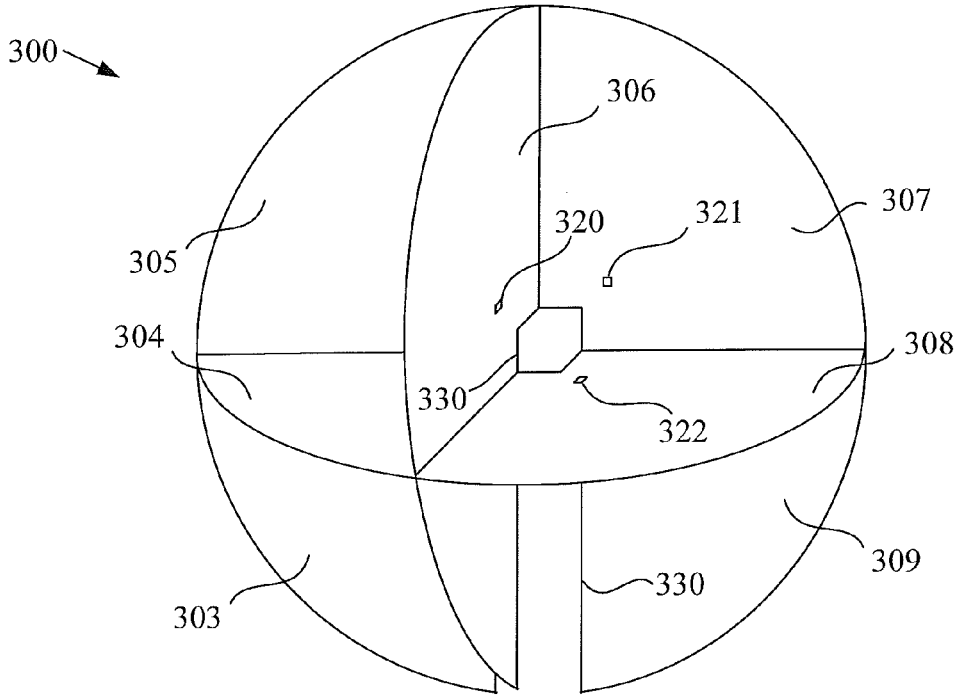
FIG. 12 is a perspective view of an illumination device similar to that of FIG. 10, but with fewer fins.
Figure 13:
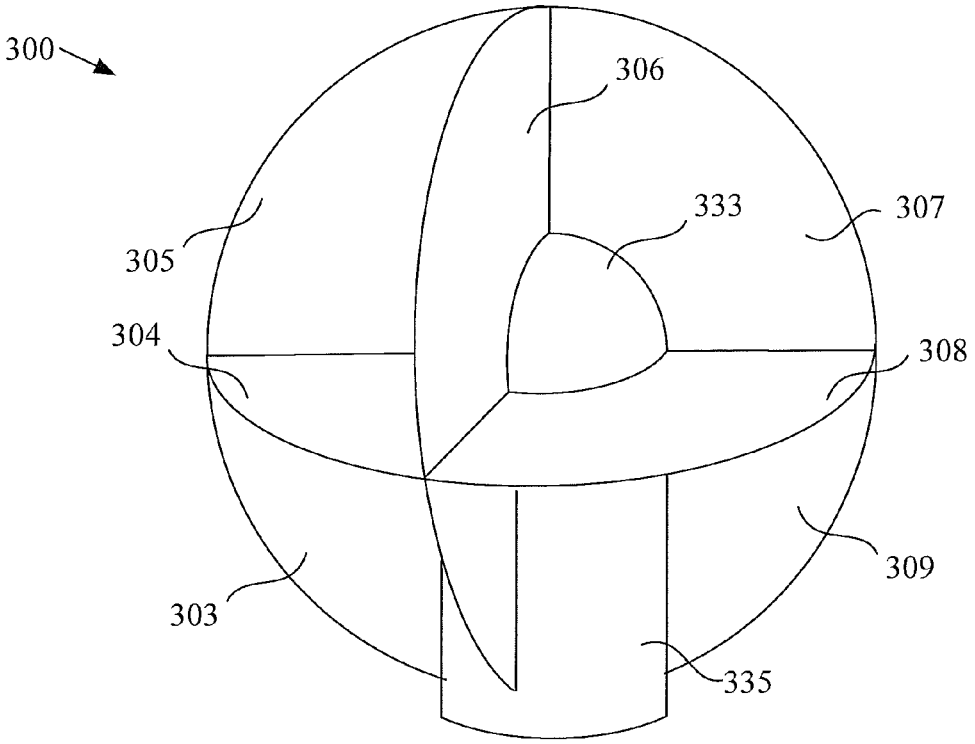
FIG. 13 is a perspective view of the illumination device of FIG. 12, in which the LEDs and central opening are encircled by a translucent shroud.

FIG. 12 and FIG. 13 show perspective views of an illumination device 300 similar to that of FIG. 10, but with fewer fins 303-309. In FIG. 12, LEDs 320, 321 and 322 are shown mounted on respective fins 306, 307 and 308. An opening 330 is defined by a gap between the inner edges of the fins at a central location of device 300. In FIG. 13, the LEDs and central opening are encircled by a translucent shroud including shroud portions 333 and 335. The embodiments shown in FIG. 10 and FIG. 11 can be attached to a base such as base 65 shown in FIG. 1.

Figure 14:
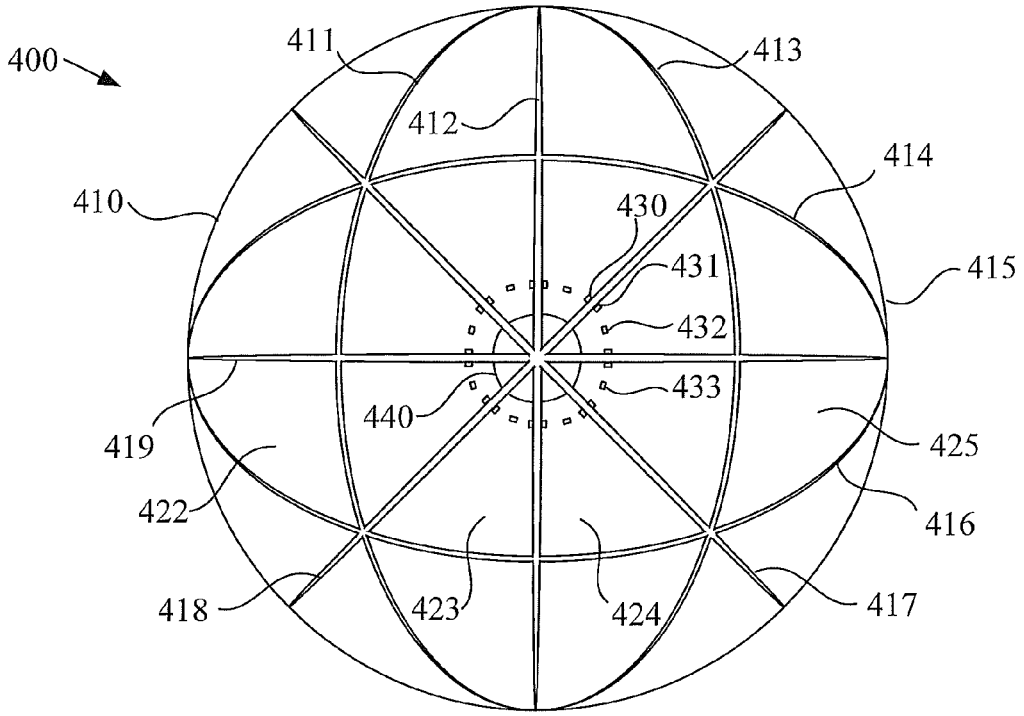
FIG. 14 is a perspective view of an illumination device similar to that of FIG. 10, but with more thermally conductive, light-reflective fins.

FIG. 14 shows a perspective view of an illumination device 400 similar to that of FIG. 10, but with more thermally conductive, light-reflective fins 410-419. In one embodiment, fins such as fin 416 are divided into several fin portions 422, 423, 424 and 425. Multiple LEDs are mounted on the fins, such as LEDs 430 and 431 mounted on fin 418, and LEDs 432 and 433 mounted on fin 413. As with other embodiments, a translucent shroud can surround the LEDs, smoothing, redirecting and optionally reradiating some of the light from the LEDs. The fins are light-reflective in the sense that the vast majority of visible light that impinges at an angle normal to a major surface of a fin is not absorbed.

Figure 15:
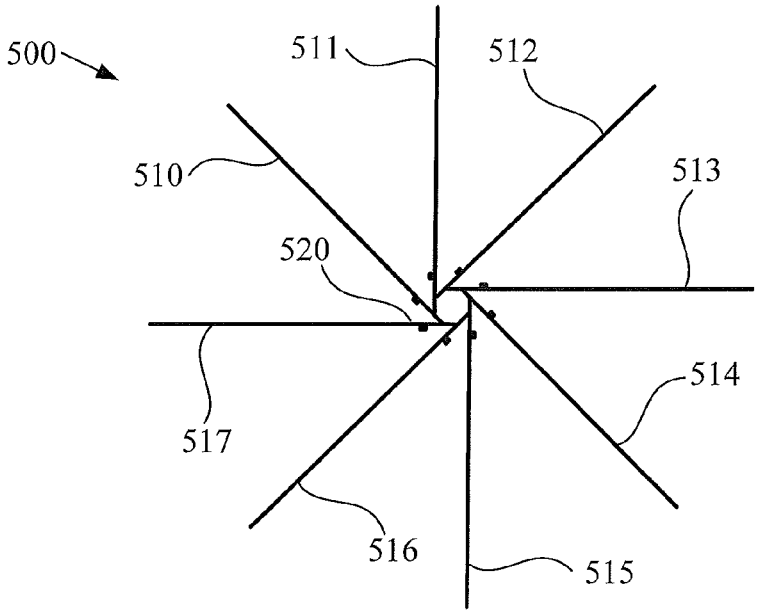
FIG. 15 is a top cross-sectional view of an illumination device similar to that shown in FIGS. 1 and 2, having thermally conductive, light reflective fins that extend outward from a central location.

FIG. 15 is a top cross-sectional view of an illumination device 500 similar to that shown in FIGS. 1 and 2, having thermally conductive, light reflective fins 510-507 that extend outward from a central location. LEDs 520 are mounted on the fins 510-517 much closer to the center of the device 500 than to the outer edges of the fins, and the fins can be held in place with a base and stand similar to that shown in FIGS. 1 and 2.

Alternatively, an octagonal stand can be disposed at the center of the device 500, with a portion of each of the fins 510-507 abutting a side of the stand. A translucent shroud similar to that shown in FIG. 6 can also be attached to the fins closer to the center of the device 500 than to the outer edges of the fins 510-517.

Figure 16:
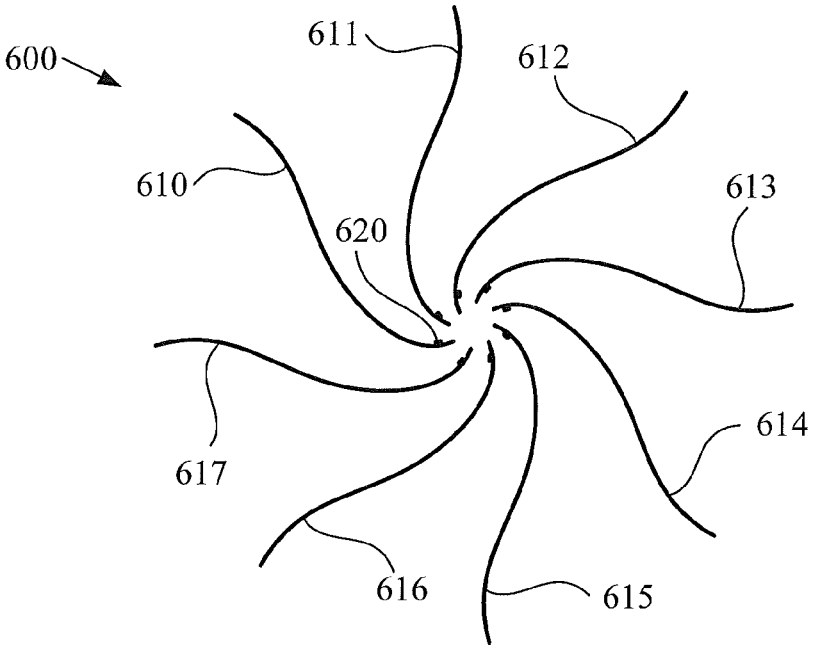
FIG. 16 is a top cross-sectional view of another illumination device similar to that shown in FIGS. 1 and 2, having thermally conductive, light reflective fins that extend outward from a central location.

FIG. 16 is a top cross-sectional view of an illumination device 600 similar to that shown in FIGS. 1 and 2, having thermally conductive, light reflective fins 610-607 that extend outward from a central location. LEDs 620 are mounted on the fins 610-617 much closer to the center of the device 600 than to the outer edges of the fins, and the fins can be held in place with a base and stand similar to that shown in FIGS. 1 and 2. A translucent shroud similar to that shown in FIG. 6 can also be attached to the fins closer to the center of the device 600 than to the outer edges of the fins 610-617. Such a shroud may be permeable to air, as described above. In one embodiment the fins may rotate relative to the ambient air, causing the air to sweep across the fins, enhancing cooling.

Figure 17:
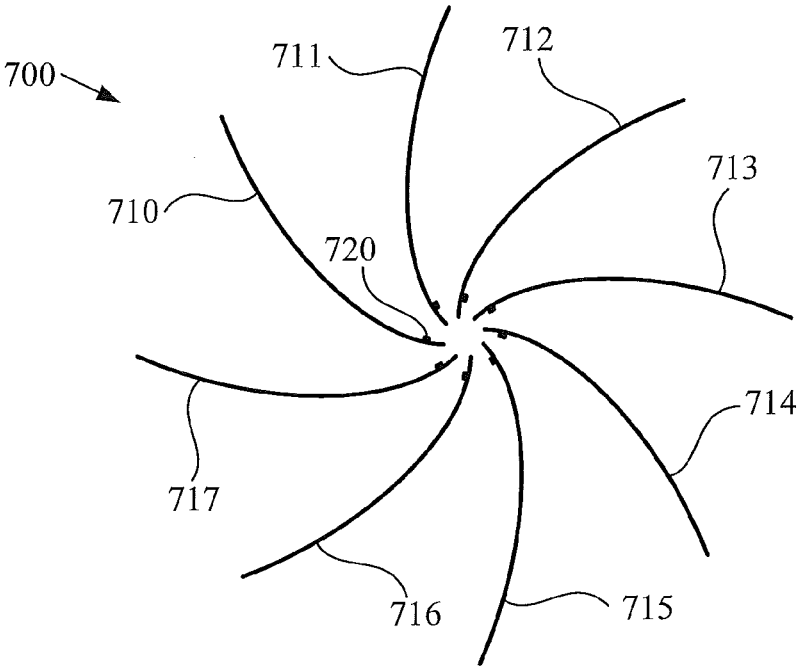
FIG. 17 is a top cross-sectional view of another illumination device similar to that shown in FIGS. 1 and 2, having thermally conductive, light reflective fins that extend outward from a central location.

FIG. 17 is a top cross-sectional view of an illumination device 700 similar to that shown in FIGS. 1 and 2, having thermally conductive, light reflective fins 710-707 that extend outward from a central location. LEDs 720 are mounted on the fins 710-717 much closer to the center of the device 700 than to the outer edges of the fins, and the fins can be held in place with a base and stand similar to that shown in FIGS. 1 and 2. A translucent shroud similar to that shown in FIG. 6 can also be attached to the fins closer to the center of the device 700 than to the outer edges of the fins 710-717. Such a shroud may be permeable to air, as described above. In one embodiment the fins may rotate relative to the ambient air, causing the air to sweep across the fins, enhancing cooling.

Figure 18:
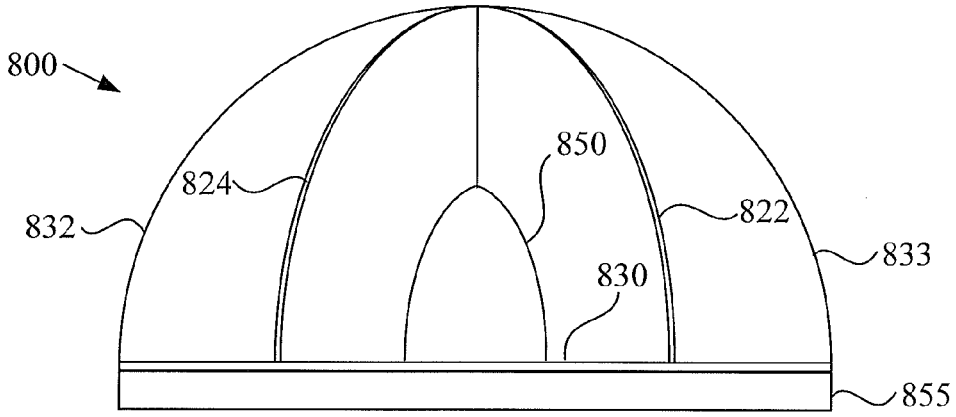
FIG. 18 is a perspective view of an embodiment of an illumination device 800 similar to that shown in FIG. 10 but in which the device is substantially semispherical rather than substantially spherical.

FIG. 18 is a perspective view of an embodiment of an illumination device 800 similar to that shown in FIG. 10 but in which the device is substantially semispherical rather than substantially spherical. LEDs, not shown in this embodiment, are disposed within a translucent shroud including shroud portion 850. Leads for the LEDs can also be obscured from vision by the shroud portion 850. Shroud portion 850 is attached to fins 822, 824 and to base portion 830, which like the fins 822 and 824 is thermally conductive and light reflective. Similar shroud portions, not shown, are attached to thermally conductive and light reflective fins 232 and 233. The shroud portions smooth and redirect the light from the LEDs, and may absorb and reradiate some of the light. For example, the shroud portions may contain phosphors that fluoresce when radiated by the LEDs. Device 800 may be mounted on a flat surface such as a wall or ceiling by a mount portion 855, which may also contain electronics for powering the LEDs.

Figure 19:
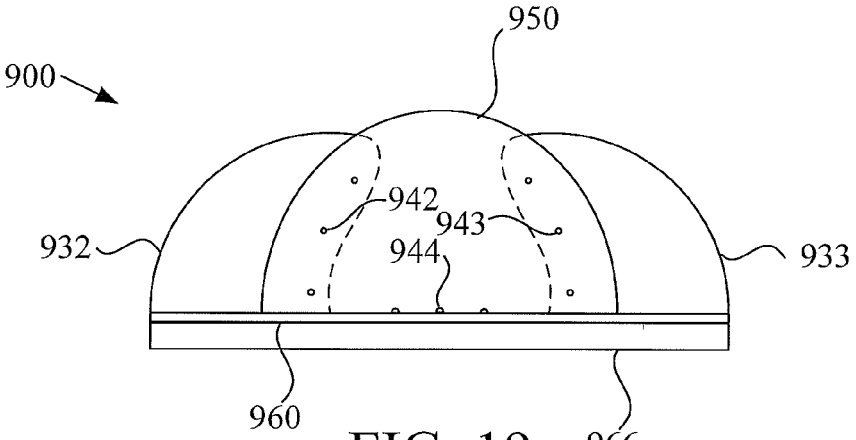
FIG. 19 is a schematic view of an embodiment of a substantially semispherical illumination device similar to that shown in FIG. 18 but in which a translucent shroud extends, near a central location, beyond a group of thermally conductive and light reflective fins that extend outward from the central location.

FIG. 19 is a schematic view of an embodiment of a substantially semispherical illumination device 900 similar to that shown in FIG. 18 but in which a translucent shroud 950 extends, near a central location, beyond a group of thermally conductive and light reflective fins that extend outward from the central location. Two fins 932 and 933 are shown, with LEDs 942 mounted on fin 932 and LEDs 943 mounted on fin 933 within an enclosure provided by the shroud 950. Additional LEDs 944 may be mounted on a within the shroud on a thermally conductive and light reflective base portion 960. Device 900 may be mounted on a flat surface such as a wall or ceiling by a mount portion 966, which may also contain electronics for powering the LEDs.

Figure 20:
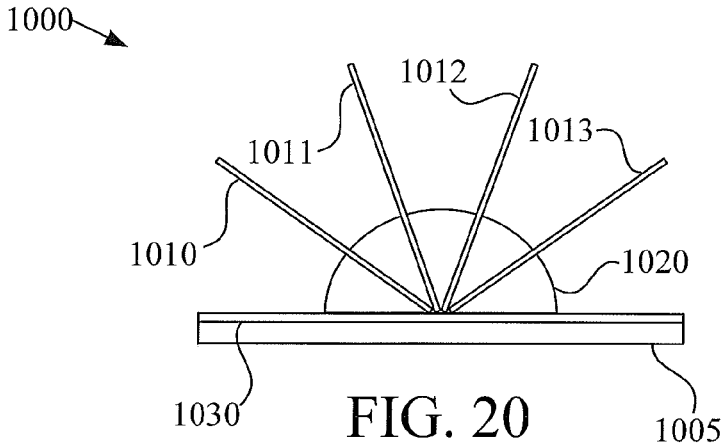
FIG. 20 is a side cross-sectional view of an illumination device having a mount portion for attachment to a flat surface such as a wall or ceiling.

FIG. 20 is a side cross-sectional view of an illumination device 1000 having a mount portion 1005 for attachment to a flat surface such as a wall or ceiling, the mount portion optionally containing electronics for powering LEDs. Similar to other embodiments, device 1000 has thermally conductive, light reflective fins 1010-1013 that extend outward from a central location. An optional translucent shroud 1020 may have shroud portions disposed between the fins. Each of the fins may have a substantially semispherical shape, and the shroud 1030 may have a substantially semispherical shape so that the overall device also has a substantially semispherical shape. LEDs may be mounted on the fins 1010-1013 much closer to the center of the device 1000 than to the outer edges of the fins, similar to those shown in FIGS. 2 and 7, or the LEDS may be mounted on thermally conductive segments disposed between and in thermal communication with adjacent fins, similar to those shown in FIG. 8. Thermally conductive, light reflective base portion 1030 is attached to the fins and to mount portion 1005.

Figure 21:
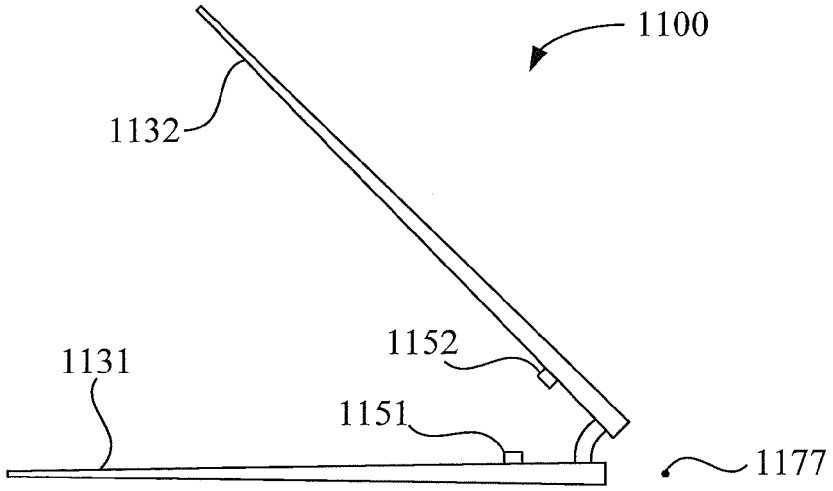
FIG. 21 is a top cross-sectional view of two of the fins of an illumination device in which the fins may be tapered to decrease in thickness further from the central location.

FIG. 21 shows a portion of an illumination device 1100 including fins 1131 and 1132, with LEDs 1151 and 1152 mounted thereon. Fins 1131 and 1132 are tapered to decrease in thickness further from a central location 1177 of the device.

Figure 22:
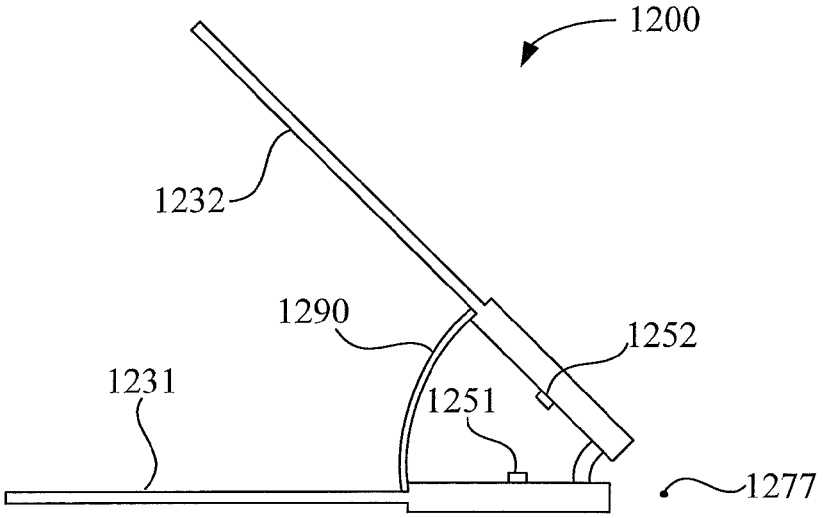
FIG. 22 is a top cross-sectional view of two of the fins of an illumination device in which the fins have a step at which they decrease in thickness further from the central location.

FIG. 22 shows a portion of an illumination device 1200 including fins 1231 and 1232, with LEDs 1251 and 1252 mounted thereon. Fins 1231 and 1232 have a step that abuts a translucent shroud 1290 at which they decrease in thickness further from a central location 1277 of the device.

The foregoing description of the embodiments of the invention has been presented for the purposes of illustration and description. It is not intended to be exhaustive or to limit the invention to the precise form disclosed. For example, although an LED is disclosed other sources of electromagnetic radiation may instead be used. Similarly, although several of the figures show embodiments having fins with outer edges that are a fraction of a circle, various other shapes may be used, such as bulb or flame shapes. Many modifications and variations are possible in light of the above teaching. It is intended that the scope of the invention be limited not by this detailed description, but rather by the claims appended hereto.

The invention claimed is:

1. An illumination device comprising:

at least three thermally conductive fins that are attached to each other adjacent a central location and extend outward from the central location, each of the fins having an opposed pair of major surfaces; and a plurality of light-emitting diodes that emit light and produce heat, with at least one of the light-emitting diodes being mounted on each of the fins, wherein the heat flows from the light-emitting diode along the fin and is radiated from at least one of the major surfaces, while the light from the light-emitting diode is reflected from the major surface and exits the device.

2. The device of claim 1, wherein each of the fins is attached to an adjacent fin with a light reflective body that is disposed closer than the light-emitting diodes to the central location.

3. The device of claim 1, wherein each of the fins is in contact with an adjacent fin at a place that is closer than the light-emitting diodes to the central location.

4. The device of claim 1, wherein the light is reflected from a second of the major surfaces.

5. The device of claim 1, wherein the fins extend radially outward from the central location.

6. The device of claim 1, wherein the fins spiral outward from the central location.

7. The device of claim 1, wherein the fins have a thickness measured between the major surfaces, and the thickness decreases with increasing distance from the central location.

8. The device of claim 1, wherein the major surfaces scatter the light.

9. The device of claim 1, wherein at least a portion of one of the major surfaces is coated with a fluorescent or phosphorescent material.

10. The device of claim 1, wherein at least a part of one of the major surfaces has a plurality of facets.

11. An illumination device comprising:

at least three thermally conductive fins that are attached to each other adjacent a central location and extend outward from the central location, each of the fins having an opposed pair of major surfaces, each of the major surfaces facing a major surface of an adjacent fin; and a plurality of light-emitting diodes that emit light and produce heat, with at least one of the light-emitting diodes being mounted on each of the major surfaces of each of the fins, wherein the heat flows from the light-emitting diode along the fin and is radiated from the major surface, while the light from the light-emitting diode is reflected from the major surface of an adjacent fin to be directed away from the central location.

12. The device of claim 11, wherein the fins extend radially outward from the central location.

13. The device of claim 11, wherein the fins spiral outward from the central location.

14. The device of claim 11, wherein the fins have a thickness measured between the major surfaces, and the thickness decreases with increasing distance from the central location.

15. The device of claim 11, wherein the major surfaces scatter the light.

16. The device of claim 11, wherein at least a portion of one of the major surfaces is coated with a fluorescent or phosphorescent material.

17. The device of claim 11, wherein at least a part of one of the major surfaces has a plurality of facets.

18. An illumination device comprising:

at least three thermally conductive fins that are attached to each other adjacent a central location and extend outward from the central location, each of the fins having an opposed pair of major surfaces and an edge that is disposed distal to the central location; and a plurality of light-emitting diodes that emit light and produce heat, with at least one of the light-emitting diodes being mounted on each of the fins, wherein the heat flows from the light-emitting diode along the fin and is radiated from at least one of the major surfaces, while the light from the light-emitting diode is reflected from the major surface and exits the device.

19. The device of claim 18, wherein the edges together outline a substantially spherical shape.

20. The device of claim 18, wherein the edges together outline a substantially semispherical shape.

21. The device of claim 18, wherein the edges together outline a bulb shape.

* * * * *